United States Patent [19]

Lee

[11] Patent Number: 4,933,513

[45] Date of Patent: Jun. 12, 1990

[54] ELECTRICAL SIGNAL CONDUCTOR ASSEMBLY

[76] Inventor: Noel Lee, 47 W. Park Dr., Daly City, Calif. 94015

[21] Appl. No.: 348,409

[22] Filed: May 8, 1989

[51] Int. Cl.[5] ..... H01B 11/02; H01B 7/08

[52] U.S. Cl. ..... 174/115; 174/72 C; 174/117 R; 174/117 F

[58] Field of Search ..... 174/115, 117 R, 117 F, 174/700, 72 C

[56] References Cited

U.S. PATENT DOCUMENTS

| | | | |
|---|---|---|---|
| 2,158,867 | 5/1939 | Schwabacher | 174/117 F |
| 3,274,329 | 9/1966 | Timmons | 174/69 |
| 3,549,788 | 12/1970 | Apen | 174/107 |
| 3,584,139 | 6/1971 | Swanson et al. | 174/103 |
| 3,602,632 | 8/1971 | Oltis | 174/36 |
| 3,816,644 | 6/1974 | Giffel et al. | 174/115 |
| 4,012,577 | 3/1977 | Lang et al. | 174/27 |
| 4,110,554 | 8/1978 | Moore et al. | 174/101.5 |
| 4,383,725 | 5/1983 | Bogese et al. | 174/36 X |
| 4,423,306 | 12/1983 | Fox | 174/115 X |
| 4,449,012 | 5/1984 | Voser | 174/70 A |
| 4,449,013 | 5/1984 | Garschick | 174/103 |
| 4,538,023 | 8/1985 | Brisson | 174/128.1 |
| 4,731,506 | 3/1988 | Lee | 174/115 |
| 4,734,544 | 3/1988 | Lee | 174/115 X |
| 4,777,324 | 10/1988 | Lee | 174/34 |

FOREIGN PATENT DOCUMENTS

| | | | |
|---|---|---|---|
| 1465554 | 3/1969 | Fed. Rep. of Germany . | |
| 2306386 | 8/1974 | Fed. Rep. of Germany . | |
| 2900302 | 7/1980 | Fed. Rep. of Germany . | |
| 3405302 | 9/1985 | Fed. Rep. of Germany . | |
| 959946 | 4/1950 | France | 174/117 F |
| 1472221 | 3/1967 | France . | |

*Primary Examiner*—Morris H. Nimmo

*Attorney, Agent, or Firm*—Warren B. Kice

[57] ABSTRACT

A conductor assembly formed by a pair of cables each formed by two conductors in a side-by-side relationship. One conductor of each cable includes at least one wire and the other conductor of each cable is formed by a plurality of bundles of wires. The diameters of a portion of the wires are of a different gauge. The conductors are surrounded by insulation which is configured to permit the assembly to be installed around a corner and to permit one cable to be bent back upon the other. The two conductors of each cable can be mechanically connected together so that they together carry the positive or negative portion of the signal or can be separately connected so that they each carry different frequency components of the signal.

70 Claims, 2 Drawing Sheets

ELECTRICAL SIGNAL CONDUCTOR ASSEMBLY

BACKGROUND OF THE INVENTION

This invention relates to a conductor assembly, and more particularly, to a conductor assembly for transmitting an electrical signal between a power source and a load.

Various types of conductors, or cables, have been used to transfer electrical current, in some form of signal, between a power source and a load. For example, the signal from an audio amplifier is transmitted by a cable to a loudspeaker for producing a replica of a signal from a program source that is introduced to the amplifer. Although there is much controversy as to the optimum type of cable that should be used in this environment, there is general agreement that cables of a relative large diameter, or width, containing a multitude of individual conductors, produce the best results.

However, these type of cables are expensive, especially in stereo reproduction systems utilizing a separate stereo amplifier for the high frequencies and a separate stereo amplifier for the low frequencies, and/or separate loudspeakers, or drivers, for the high frequencies the low frequencies, since separate cable assemblies must be used for every amplifier and loudspeaker.

Also, large multi cable assemblies of this type are less than ideal from an installation standpoint since they are usually bulky, hard to handle and relatively inflexible. This problem is compounded in custom installations in which the cables should be hidden from sight.

SUMMARY OF THE INVENTION

It is an object of the present invention to provide a signal conductor assembly in which multiple conductors are provided, each consisting of one or more wires.

It is a further object of the present invention to provide a cable assembly of the above type in which at least one of the conductors carrying each signal is formed by a plurality of bundles of wires.

It is a further object of the present invention to provide a cable assembly of the above type in which at least two different conductors are provided which transfer the positive signal, and at least two additional conductors are provided which transfer the negative, or ground, signal.

It is a further object of the present invention to provide a cable assembly of the above type in which the diameter of at least one of the wires of the first or second conductor is different from the diameter of at least one other wire thereof.

It is a further object of the present invention to provide a cable assembly of the above type in which the conductors are arranged in a parallel, side-by-side relation.

It is a still further object of the present invention to provide a cable assembly of the above type in which the two different cables for respectively carrying the positive signal and the negative signal can be connected together or can be respectively connected to a high frequency amplifier and a low frequency amplifier, and/or to a high frequency loudspeaker and a low frequency loudspeaker.

It is a still further object of the present invention to provide a cable assembly of the above type which is relatively flexible, is easy to install and is especially adapted for installation around corners.

It is a still further object of the present invention to provide a cable assembly of the above type in which the two cables forming the assembly are bendable relative to each other so that one cable overlies the other along their respective lengths.

Toward the fulfillment of these and other objects, the conductor assembly of the present invention includes at least two parallel conductors for carrying the positive signal and at least two parallel conductors for carrying the negative signal. One conductor of each pair is formed by at least one wire and the other conductor consists of a plurality of bundles of twisted wires, with a portion of the wires having different diameters. Insulation extends around the conductors and is configured to enable the cable to be easily bendable.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention which taken in conjunction with the accompanying drawings wherein.

DESCRIPTION OF THE PREFERRED EMBODIMENTS

Figure 1:
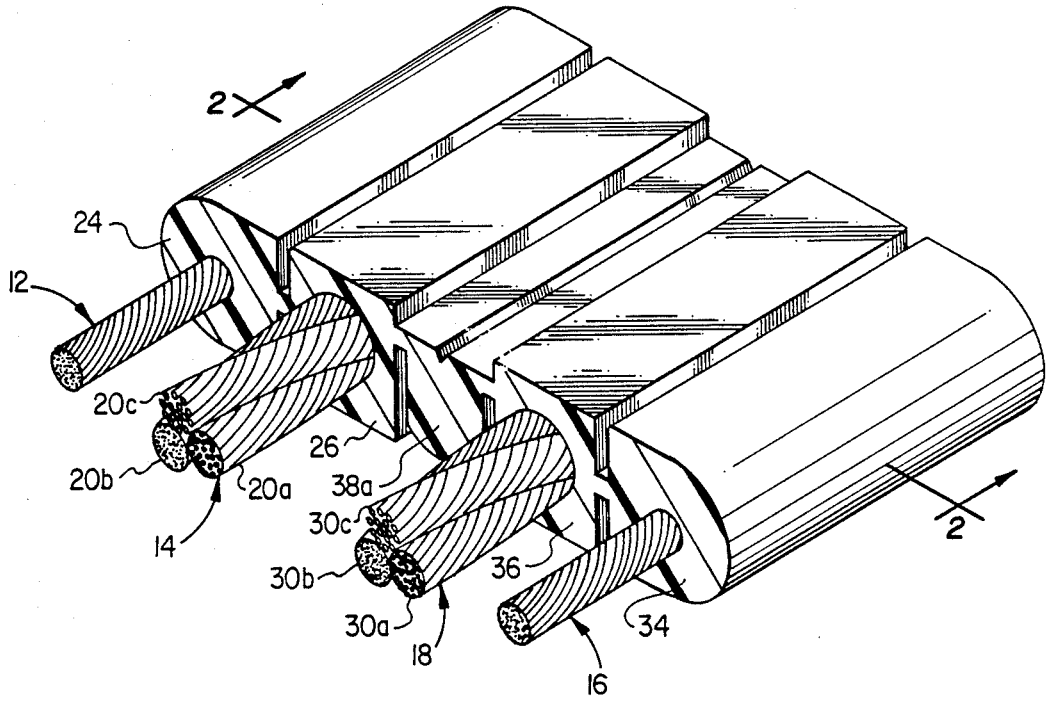
FIG. 1 is a partial perspective view depicting the signal cable assembly of the present invention, with the insulation portion of the individual conductors forming the assembly being removed from the end portions thereof for convenience of presentation.
Figure 2:
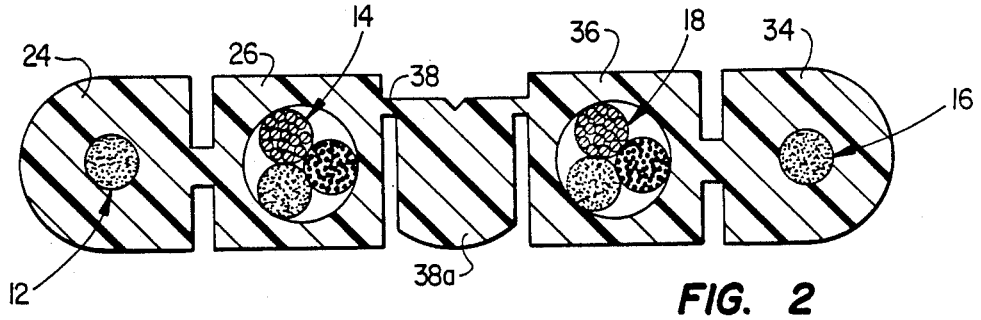
FIG. 2 is a cross-sectional view taken along the line 2—2 of FIG. 1.

Referring specifically to FIGS. 1 and 2 of the drawings, the reference numeral 10 refers in general to the conductor assembly of the present invention which comprises four conductors 12, 14, 16 and 18 extending in a parallel, side-by-side relationship. The conductors 12 and 14 together form a single cable for carrying the positive portion of the audio signal and the conductors 16 and 18 together form a single cable for carrying the negative portion of the signal, as will be explained.

The conductor 12 is formed by a bundle of wires, each of a relatively small diameter, which are spiral wrapped, or twisted, relative to each other. The number of wires and their respective diameters, or gauges, can be varied over a relatively wide range but as a non-limitative example, the conductor 12 could comprise approximately sixty wires each of a 36 gauge.

The conductor 14 is formed by three twisted bundles **20*a*, 20*b* and 20*c*. The bundle 20*a* is formed of a relatively small number of twisted wires each of a relatively large diameter, the bundle 20*b* is formed of a relatively large number of twisted wires, each of a relatively small diameter, and the bundle 20*c* consists of an intermediate number of twisted wires, each of an intermediate diameter. The number of the wires forming each bundle 20*a*, 20*b* and 20*c* and their respective diameters, or gauges, can vary over a relatively wide range and, as a non-limitative example, the bundle 20*a* could comprise approximately sixteen twisted wires each of a 30 gauge (AWG), the bundle 20b could comprise approximately sixty twisted wires each of a 36 gauge and the bundle 20c** could comprise approximately forty twisted wires each of a 34 gauge.

Insulating sleeves 24 and 26 extend around the conductor 12 and the conductor 14, respectively, and have been depicted in FIG. 1 with their end portions removed to better depict the respective wires of the latter conductors.

The conductor 16 is identical to the conductor 12 and, as such, is formed by a bundle of wires each of a relatively small diameter, or gauge, which are spiral wrapped, or twisted, relative to each other.

The conductor 18 is identical to the conductor 14 and thus is formed by three bundles 30a, 30b and 30c of wire strands sized, twisted and configured identically to the bundles 20a, 20b and 20c, respectively, of the conductor 14.

Insulating sleeves 34 and 36 extend around the conductors 16 and 18, respectively. The sleeves 34 and 36 have also been depicted in FIG. 1 with their end portions removed.

The wires forming the conductors 12, 14, 16 and 18 are of a current carrying material, such as copper and the insulating material forming the sleeves 24, 26, 34 and 36 is of a plastic or rubber.

The larger number of wires in the conductors 14 and 18 are designed to transfer the relatively low frequency components of the signal, while the smaller number of wires of the conductors 12 and 16 can transfer the relatively high frequency components of the signal, as will be described.

The sleeves 24 and 26 are disposed in a juxtaposed, parallel, side-by-side relationship with their corresponding sidewall portions being molded together, while the sleeves 34 and 36 are formed in the same manner. The insulating material forming the sleeves 24, 26, 34 and 36 is molded into an integral unit, with the adjacent walls of the sleeves 26 and 36 separated by a relatively thin strip 38 of insulating material extending integrally therewith. The thickness, or height, of the strip 38 is reduced when compared to that of the sleeves 24, 26, 34 and 36 and the strip includes an enlarged portion, or ridge 38a extending for the length of the cable assembly 10, for reasons to be described.

Figure 3:
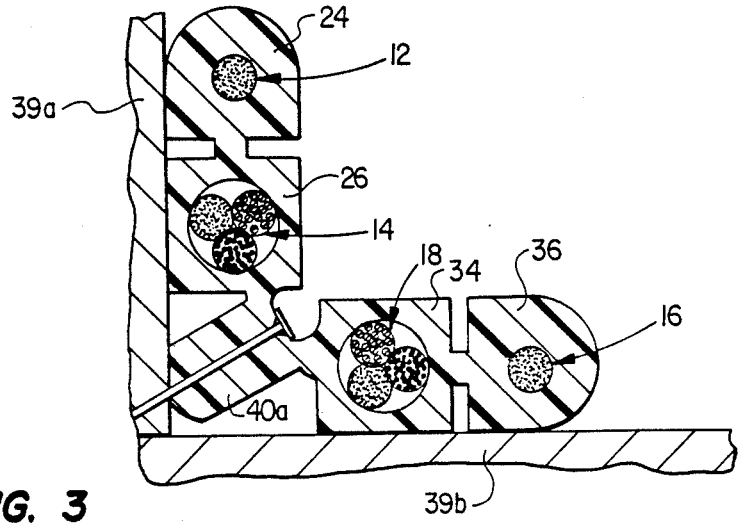
FIG. 3 is a view similar to FIG. 2, but depicting the cable installed around a corner.

As shown in FIG. 3, the overall configuration of the cable assembly 10, and especially the insulating strip 38 and the ridge 38a, enables the assembly to easily be installed around an interior corner formed by two interior walls 39a and 39b. The increased flexibility gained by the provision of the strip 38 of a reduced thickness enables the assembly 12 to be bent so that the conductors 12 and 14 can rest against one wall, such as 39a, while the conductors 16 and 18 can rest against the other wall 39b. A tack, or nail then can be driven through the ridge 38a and into one of the walls to secure the assembly 10, as shown.

Figure 4:
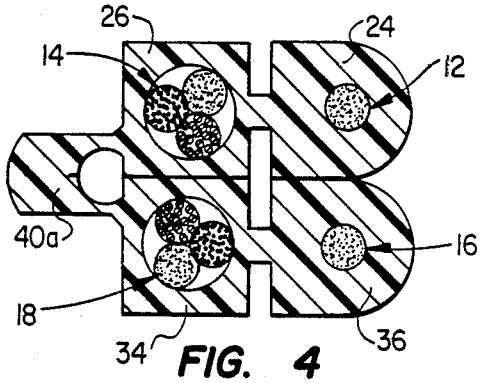
FIG. 4 depicts the cable assembly of FIG. 2 with one cable bent back over the other cable.

The provision of the relatively thin strip 38 extending between the sleeves 26 and 36 enables the cable formed by the conductors 12 and 14 to be bent relative to the cable formed by the conductors 16 and 18 as shown in FIG. 4 so that the former cable lies over the latter cable along their respective lengths. This, of course, results in a smaller package from a width standpoint and increases the installation flexability of the assembly.

Figure 5:
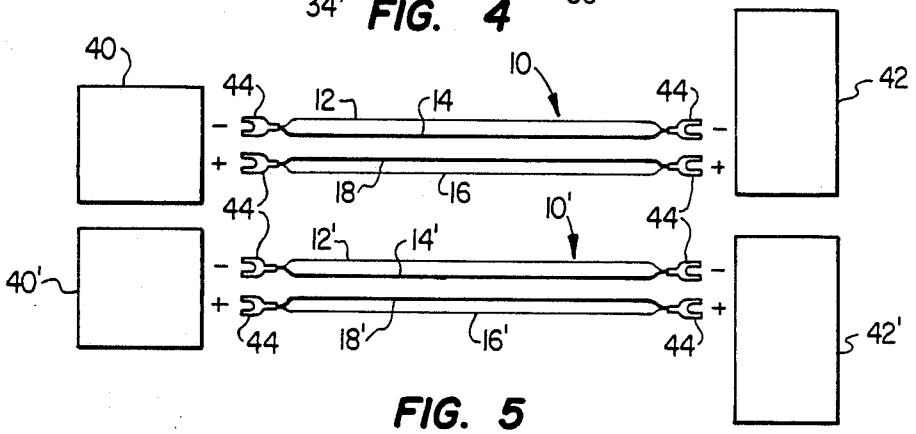
FIGS. 5–7 are schematic views depicting the cable assembly of FIG. 1 shown connected in these different configurations.
Figure 6:
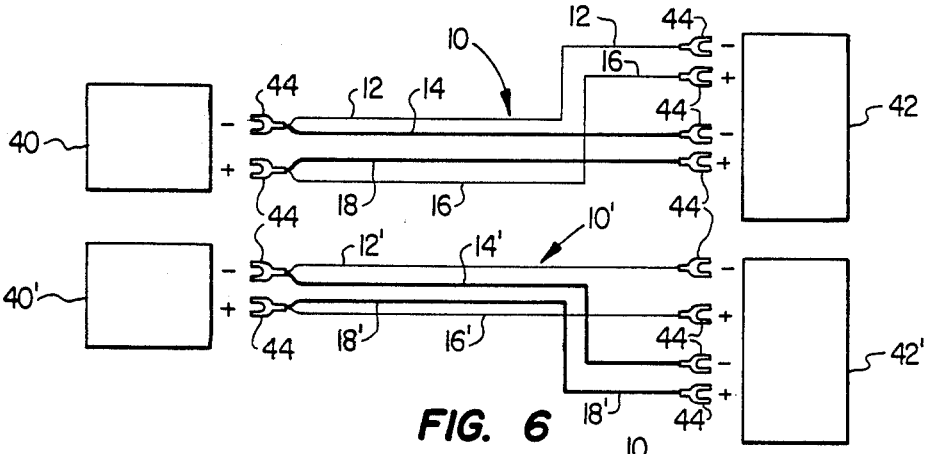
Figure 7:
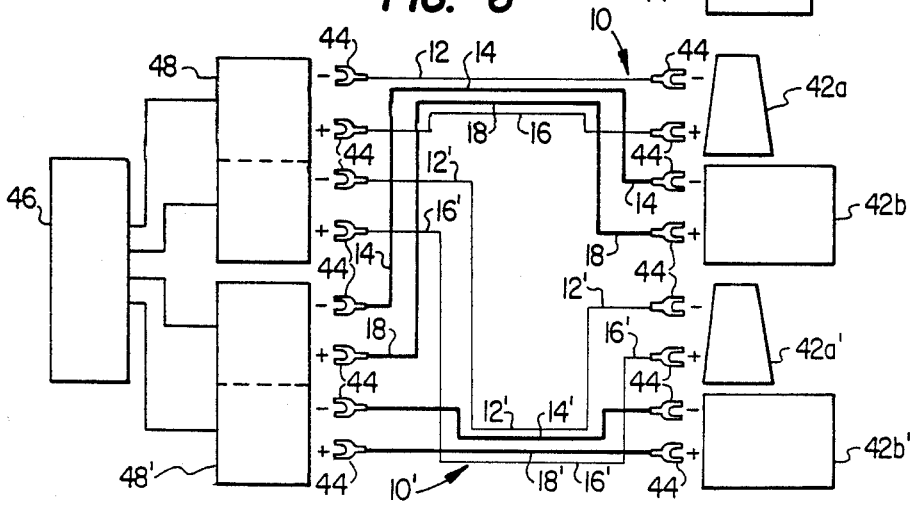

FIGS. 5–7 depict the cable assembly 10, along with an identical assembly 10' connected in three different manners in three different audio systems. Prior to use, the end portions of the sleeves 24, 26, 34 and 36 are stripped from the conductors 12, 14, 16 and 18, respectively, of the cable assembly 10 and from the conductors 12', 14', 16', and 18' of the cable assembly 10' as shown in FIG. 1. According to the arrangement of FIG. 5, the respective uninsulated end portions of the conductors 12 and 14 of the cable assembly 10 are twisted, or otherwise connected together, to form a single cable for carrying the positive signal between an amplifier 40 and one loudspeaker 42 of an stereophonic, or two channel, reproduction system. The conductors 16 and 18 are also twisted, or otherwise connected together in a similar manner to form a single cable for carrying the negative, or ground, signal between the amplifier 40 and the loudspeaker 42. The conductors 12 and 14 thus together function together as one cable while the conductors 16 and 18 function together as one cable.

The conductors 12', 14', 16' and 18' of the cable assembly 10' are connected in a manner identical to that just described in connection with the cables 12, 14, 16, 18, respectively, but are connected between an amplifier 40' and a loudspeaker 42' which form the other channel of the stereophonic reproduction system. It is understood that, although the amplifiers 40 and 40' are depicted as being separate they, in fact, can be integrated into a single-chassis stereophonic amplifier. Also, it is understood that the loudspeakers can include multiple drivers (not shown) for reproducing different portions of the frequency spectrum in a conventional manner.

Spade lugs 44 are provided on the respective uninsulated connected ends of each cable assembly 10 and 10' to facilitate their connections between the positive and negative terminals of the amplifiers 40 and 40' and the loudspeakers 42 and 42', respectively.

In the arrangement of FIG. 6 the ends of each of the cable assembies 10 and 10' are connected to the amplifiers 40 and 40', respectively in a manner identical to that of FIG. 5, while the other ends thereof are connected to loudspeakers 42 and 42', respectively. However, in this embodiment the cable 16 is connected to the positive terminal of the high-frequency driver (not shown) of the loudspeaker 42, cable 12 is connected to the negative terminal of the latter driver, while the cables 18 and 14 are respectively connected to the positive and negative terminals of the low frequency driver of the loudspeaker 42. In a similar manner, the cable 16' is connected to the positive terminal of the high frequency driver of the loudspeaker 42', the cable 12' is connected to the negative terminal of the latter driver, while the cable 18' and 14' are respectively connected to the positive and negative terminals of the low frequency driver of the loudspeaker 42'.

According to the arrangement of FIG. 7, an electronic crossover 46 is provided which divides the audio signal into high frequency components which are distributed to an amplifier 48 which functions as a high fequency amplifier for both stereophonic channels, and low frequency components which are distributed to an amplifier 48' which functions as a low frequency stereophonic amplifier. Since the crossover 46, and the use of it in connection with the two stereophonic amplifiers 48 and 48', are conventional they will not be described in any further detail.

One end of the cable 12 of the cable assembly 10 is connected to the negative terminal of the high frequency amplifier 48 and one end of the cable 16 is connected to the positive terminal of the latter amplifier. In a similar manner, one end of cable 14 is connected to the negative terminal of the high frequency amplifier 48' and one end of the cable 18 is connected to the positive terminal of the latter amplifier. The corresponding ends of the cable assembly 10' are connected in a similar manner as just described in connection with the cable assembly 10. The arrangment of FIG. 7 utilizes loudspeakers **42*a* and 42*a'* for reproducing the high frequency components of the audio signal for the respective two channels of reproduction, and loudspeakers 42*b* and 42*b'* for reproducing the respective lower frequency components thereof. Thus, according to this arrangement, the corresponding end of the conductor 12 of the cable assembly 10 is connected to the negative terminal of the high frequency speaker 42*a* and the conductor 16 is connected to the positive terminal thereof. In a similar manner, the conductor 14 of the cable assembly 10 is connected to the negative terminal of the low frequency loudspeaker 42*b* and the conductor 18 is connected to the positive terminal thereof. The cable assembly 10' is connected in an identical manner to the loudspeaker 42*a'* for reproducing the high frequency components of the other channel of stereophonic reproduction, and the loudspeaker 42*b*** for reproducing the low frequencies components.

It is thus seen that the cable assembly of the present invention is extremely versatile since it can be utilized in a normal configuration in which one amplifier is connected to one speaker as depicted in FIG. 5, in a bi-wire, dual loudspeaker configuration in which a single amplifier drives two loudspeakers (FIG. 6) and in the bi-amp, dual-speaker configuration of FIG. 7.

It is understood that several other variations may be made in the foregoing without departing from the scope of the invention. For example, the cable assembly 10 is not limited to two conductors 12 and 14 carrying one portion of the signal (such as positive) and two conductors 16 and 18 carrying the other portion of the signal (such as negative, or ground). Also the cable assembly of the present invention is not limited to a bi-wire or dual speaker arrangement but can be extended to accommodate additional amplifiers and/or loudspeakers as necessary by simply providing additional conductors on each cable assembly.

Also, connectors other than the spade lugs 44 can be connected to the uninsulated end(s) of the conductors of the cable assembly of the present invention for facilitating connection to the terminals of the amplifiers and loudspeakers. Examples of these alternate connectors are banana plugs, pin connectors, and the like.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A conductor assembly for transmitting an electrical signal between a power source and a load, said assembly comprising:

(1) a first cable for carrying the positive portion of said signal, said first cable comprising:
  (a) a first conductor comprising at least one wire;
  (b) a second conductor extending to the side of said first conductor in a spaced, parallel relation thereto and comprising a plurality of bundles of wires;
  (c) the diameters of at least one of said wires of said first cable being different from the diameter of at least one other of said wires of said first cable;
  (d) an insulating material extending around said first and second conductors of said first cable;
  (e) said first and second conductors of said first cable being adapted to separately carry different frequency components of said positive signal portion;

(2) a second cable extending to the side of said first cable in a spaced parallel relationship for carrying the negative portion of said signal, said second cable comprising:
  (a) a first conductor comprising at least one wire;
  (b) a second conductor extending to the side of said first conductor in a spaced, parallel realtion thereto and comprising a plurality of bundles of wires;
  (c) the diameters of at least one of said wires of said second cable being different from the diameter of at least one other of said wires of said second cable;
  (d) an insulating material extending around said first and second conductors of said second cable;
  (e) said first and second conductors of said second cable being adapted to separately carry different frequency components of said negative signal portion;

(3) said first conductor and said second conductor of said first cable and said first conductor and said second conductor of said second cable extending in a side-by-side relationship, and said first cable and said second cable extending in a side-by-side relationship so that all of said conductors are co-planer; and (4) an insulating material extending between said first and second cables.

2. The cable assembly of claim 1 wherein said wires of each of said bundles of each of said second conductors are twisted.

3. The conductor assembly of claim 2 wherein said bundles of each said second conductors are twisted in a direction opposite the direction of twist of their respective wires.

4. The cable assembly of claim 1 wherein the first and second conductors of said first cable are connectable together to together transfer said positive signal portion, and wherein the first and second conductors of said second cable are connectable together to together said negative signal portion.

5. The cable assembly of claim 1 wherein said insulating material of said first and second cables is molded into an integral single unit including a plurality of sleeves respectively extending over said first and second conductors of said first and second cables.

6. The cable assembly of claim 5 wherein said insulating material extending between said cables is of a relative small thickness to permit movement of said first cable relative to said second cable.

7. The cable assembly of claim 1 wherein the thickness of said last-mentioned insulating material is sufficient to permit said first and second cables to be bent to a position where they extend substantially perpendicular.

8. A conductor assembly for transmitting an electrical signal between a power source and a load, said assembly comprising:

(1) a first cable for carrying the positive portion of said signal, said first cable comprising:
  (a) a first conductor comprising at least one wire;
  (b) a second conductor extending to the side of said first conductor in a spaced, parallel relation thereto and comprising a plurality of bundles of wires;
  (c) the diameters of at least one of said wires forming at least one bundle of said first cable being different from the diameter of at least one of said wires forming another bundle of said first cable;
  (d) an insulating material extending around said first and second conductors of said first cable;
  (e) said first and second conductors of said first cable being adapted to separately carry different frequency components of said positive signal portion;

(2) a second cable extending to the side of said first cable in a spaced parallel relationship for carrying the negative portion of said signal, said second cable comprising:
  (a) a first conductor comprising at least one wire;
  (b) a second conductor extending to the side of said first conductor in a spaced, parallel relation thereto and comprising a plurality of bundles of wires;
  (c) the diameters of at least one of said wires forming at least one bundle of said second cable being different from the diameter of at least one of said wires forming another bundle of said second cable;
  (d) an insulating material extending around said first and second conductors of said second cable;
  (e) said first and second conductors of said second cable being adapted to separately carry different frequency components of said negative signal portion; and (3) an insulating material extending between said first and second cables.

9. The cable assembly of claim 8 wherein said first conductor of said first and second cables comprises a plurality of twisted wires.

10. The cable assembly of claim 8 wherein each of said second conductor of said first and second cables comprises a bundle of relatively large diameter wires, a bundle of relatively small diameter wires, and a bundle of relatively intermediate diameter wires.

11. The cable assembly of claim 8 wherein said first conductor of said first and second cables comprises a bundle of wires.

12. The cable assembly of claim 8 wherein the diameters of the wires forming said first conductor of said first and second cables are the same size as the diameters of the wires forming one of said bundles of said second conductor of said first and second cables.

13. The cable assembly of claim 8 wherein said wires of each of said bundles of said second conductor of said first and second cables are twisted.

14. The cable assembly of claim 13 wherein said bundles of said second conductor of said first and second cables are twisted in a direction opposite the direction of twist of their respective wires.

15. The cable assembly of claim 8 wherein the first and second conductors of said first cable are connectable together to together transfer said positive signal portion, and wherein the first and second conductors of said second cable are connectable together to together said negative signal portion.

16. The cable assembly of claim 8 wherein said insulating material of said first and second cables is molded into an integral single unit including a plurality of sleeves respectively extending over said first and second conductors of said first and second cables.

17. The cable assembly of claim 8 wherein said insulating material extending between said cables is of a relative small thickness to permit movement of said first cable relative to said second cable.

18. The cable assembly of claim 8 further comprising a ridge formed on said insulating material extending between said cables for receiving a nail to fasten said assembly to a wall.

19. The cable assembly of claim 8 wherein said first cable is adapted to lie flat against a first wall and said second cable is adapted to lie flat against a wall perpendicular to said first wall.

20. A conductor assembly for transmitting an electrical signal between a power source and a load, said assembly comprising:

(1) a first cable for carrying the positive portion of said signal, said first cable comprising:
  (a) a first conductor comprising at least one wire;
  (b) a second conductor extending to the side of said first conductor in a spaced, parallel relation thereto and comprising a bundle of relatively large diameter wires, a bundle of relatively small diameter wires, and a bundle of relatively intermediate diameter wires;
  (c) the diameters of at least one of said wires of said first cable being different from the diameter of at least one other of said wires of said first cable;
  (d) an insulating material extending around said first and second conductors of said first cable;
  (e) said first and second conductors of said first cable being adapted to separately carry different frequency components of said positive signal portion;

(2) a second cable extending to the side of said first cable in a spaced parallel relationship for carrying the negative portion of said signal, said second cable comprising:
  (a) a first conductor comprising at least one wire;
  (b) a second conductor extending to the side of said first conductor in a spaced, parallel relation thereto and comprising a bundle of relatively large diameter wires, a bundle of relatively small diameter wires, and a bundle of relatively intermediate diameter wires;
  (c) the diameters of at least one of said wires of said second cable being different from the diameter of at least one other of said wires of said second cable;
  (d) an insulating material extending around said first and second conductors of said second cable;
  (e) said first and second conductors of said second cable being adapted to separately carry different frequency components of said negative signal portion; and (3) an insulating material extending between said first and second cables.

21. The cable assembly of claim 20 wherein each of said first conductors comprises a plurality of twisted wires.

22. The cable assembly of claim 28 wherein the diameters of the wires forming each of said first conductors are the same size as the diameters of the wires forming one of said bundles of each of said second conductors.

23. The cable assembly of claim 20 wherein said wires of each said bundles of each of said second conductors are twisted.

24. The conductor assembly of claim 31 wherein said bundles of each of said second conductors are twisted in a direction opposite the direction of twist of their respective wires.

25. The cable assembly of claim 20 wherein the first and second conductors of said first cable are connected together to together transfer said positive signal portion, and wherein the first and second conductors of said second cable are connectable together to together said negative signal portion.

26. The cable assembly of claim 20 wherein said insulating material of said first and second cables is molded into an integral single unit including a plurality of sleeves respectively extending over said first and second conductors of said first and second cables.

27. The cable assembly of claim 20 wherein at least a portion of said insulating material extending between said cables is of a relative small thickness to permit movement of said first cable relative to said second cable.

28. The cable assembly of claim 25 further comprising a ridge formed on said insulating material extending between said cables for receiving a nail to fasten said assembly to a wall.

29. The cable assembly of claim 27 wherein said first cable is adapted to lie flat against a first wall and said second cable is adapted to lie flat against a wall perpendicular to said first wall.

30. The cable assembly of claim 20 wherein said first conductor of said first and second cables comprises a bundle of wires.

31. A conductor assembly for transmitting an electrical signal between a power source and a load, said assembly comprising:

(1) a first cable for carrying the positive portion of said signal, said first cable comprising:
  (a) a first conductor comprising a plurality of twisted wires;
  (b) a second conductor extending to the side of said first conductor in a spaced, parallel relation thereto and comprising and plurality of bundles of wires;
  (c) the diameters of at least one of said wires of said first cable being different from the diameter of at least one other of said first cable;
  (d) an insulating material extending around said first and second conductors of said first cable;
  (e) said first and second conductors of said first cable being adapted to separately carry different frequency components of said positive signal portion;

(2) a second cable extending to the side of said first cable in a spaced parallel relationship for carrying the negative portion of said signal, said second cable comprising:
  (a) a first conductor comprising a plurality of twisted wires;
  (b) a second conductor extending to the side of said first conductor in a spaced, parallel relation thereto and comprising a plurality of bundles of wires;
  (c) the diameters of at least one of said wires of said second cable being different from the diameter of at least one other of said wires of said second cable;
  (d) an insulating material extending around said first and second conductors of said second cable;
  (e) said first and second conductors of said second cable being adapted to separately carry different frequency components of said negative signal portion; and (3) an insulating material extending between said first and second cables.

32. The cable assembly of claim 31 wherein each of said second conductor of said first and second cables comprises a bundle of relatively large diameter wires, a bundle of relatively small diameter wires, and a bundle of relatively intermediate diameter wires.

33. The cable assembly of claim 31 wherein said first conductor of said first and second cables comprises a bundle of wires.

34. The cable assembly of claim 31 wherein the diameters of the wires forming said first conductor of said first and second cables are the same size as the diameters of the wires forming one of said bundles of said second conductor of said first and second cables.

35. The cable assembly of claim 31 wherein said wires of each of said bundles of said second conductor of said first and second cables are twisted.

36. The cable assembly of claim 35 wherein said bundles of said second conductor of said first and second cables are twisted in a direction opposite the direction of twist of their respective wires.

37. The cable assembly of claim 31 wherein the first and second conductors of said first cable are connectable together to together transfer said positive signal portion, and wherein the first and second conductors of said second cable are connectable together to together said negative signal portion.

38. The cable assembly of claim 31 wherein said insulating material of said first and second cables is molded into an integral single unit including a plurality of sleeves respectively extending over said first and second conductors of said first and second cables.

39. The cable assembly of claim 31 wherein said insulating material extending between said cables is of a relative small thickness to permit movement of said first cable relative to said second cable.

40. The cable assembly of claim 31 further comprising a ridge formed on said insulating material extending between said cables for receiving a nail to fasten said assembly to a wall.

41. The cable assembly of claim 31 wherein said first cable is adapted to lie flat against a first wall and said second cable is adapted to lie flat against a wall perpendicular to said first wall.

42. The cable assembly of claim 31 wherein said first conductor of said first and second cables comprises a bundle of wires.

43. A conductor assembly for transmitting an electrical signal between a power source and a load, said assembly comprising:

(1) a first cable for carrying the positive portion of said signal, said first cable comprising:
  (a) a first conductor comprising at least one wire;
  (b) a second conductor extending to the side of said first conductor in a spaced, parallel relation thereto and comprising a plurality of bundles of wires;

(c) the diameters of at least one of said wires of said first cable being different from the diameter of at least one other of said wires of said first cable;

(d) an insulating material molded into an integral single unit and including two sleeves respectively extending over said first and second conductors of said first cable;

(e) said first and second conductors of said first cable being adapted to separately carry different frequency components of said positive signal portion;

(2) a second cable extending to the side of said first cable in a spaced parallel relationship for carrying the negative portion of said signal, said second cable comprising:

(a) a first conductor comprising at least one wire;

(b) a second conductor extending to the side of said first conductor in a spaced, parallel relation thereto and comprising a plurality of bundles of wires;

(c) the diameters of at least one of said wires of said second cable being different from the diameter of at least one other of said wires of said second cable;

(d) an insulating material molded into an integral single unit and including two sleeves respectively extending over said first and second conductors of said second cable;

(e) said first and second conductors of said second cable being adapted to separately carry different frequency components of said negative signal portion; and (3) an insulating material extending between said first and second cables;

(a) at least a portion of said last-mentioned insulating material is of a relatively small thickness to permit movement of said first cable relative to said second cable; and (b) said last-mentioned insulating material including a ridge extending between said cables for receiving a nail to fasten said assembly to a wall.

44. The cable assembly of claim 43 wherein said first conductor of said first and second cables comprises a plurality of twisted wires.

45. The cable assembly of claim 43 wherein each of said second conductor of said first and second cables comprises a bundle of relatively large diameter wires, a bundle of relatively small diameter wires, and a bundle of relatively intermediate diameter wires.

46. The cable assembly of claim 43 wherein said first conductor of said first and second cables comprises a bundle of wires.

47. The cable assembly of claim 43 wherein the diameters of the wires forming said first conductor of said first and second cables are the same size as the diameters of the wires forming one of said bundles of said second conductor of said first and second cables.

48. The cable assembly of claim 43 wherein said wires of each of said bundles of said second conductor of said first and second cables are twisted.

49. The cable assembly of claim 43 wherein said bundles of said second conductor of said first and second cables are twisted in a direction opposite the direction of twist of their respective wires.

50. The cable assembly of claim 43 wherein the first and second conductors of said first cable are connectable together to together transfer said positive signal portion, and wherein the first and second conductors of said second cable are connectable together to together said negative signal portion.

51. The cable assembly of claim 43 wherein said first cable is adapted to lie flat against a first wall and said second cable is adapted to lie flat against wall perpendicular to said first wall.

52. A conductor assembly for transmitting an electrical signal between a power source and a load, said assembly comprising:

(1) a first cable for carrying the positive portion of said signal, said first cable comprising:

(a) a first conductor comprising at least one wire;

(b) a second conductor extending to the side of said first conductor in a spaced, parallel relation thereto and comprising a plurality of bundles of wires;

(c) the diameters of at least one of said wires of said first cable being different from the diameter of at least one other of said wires of said first cable;

(d) an insulating material molded into an integral single unit and including two sleeves respectively extending over said first and second conductors of said first cable;

(e) said first and second conductors of said first cable being adapted to separately carry different frequency components of said positive signal portion;

(2) a second cable extending to the side of said first cable in a spaced parallel relationship for carrying the negative portion of said signal, said second cable comprising:

(a) a first conductor comprising at least one wire;

(b) a second conductor extending to the side of said first conductor in a spaced, parallel relation thereto and comprising a plurality of bundles of wires;

(c) the diameters of at least one of said wires of said second cable being different from the diameter of at least one of said wires of said second cable;

(d) an insulating material said first and second conductors of said second cable;

(e) said first and second conductors of said second cable being adapted to separately carry different frequency components of said negative signal portion; and (3) an insulating material extending between said first and second cables, at least a portion of said last-mentioned insulating material being of a relatively small thickness to permit movement of said first cable relative to said second cable so that said first and second cables can respectively lie flat against two perpendicular walls.

53. The cable assembly of claim 52 wherein said first conductor of said first and second cables comprises a plurality of twisted wires.

54. The cable assembly of claim 52 wherein each of said second conductor of said first and second cables comprises a bundle of relatively large diameter wires, a bundle of relatively small diameter wires, and a bundle of relatively intermediate diameter wires.

55. The cable assembly of claim 52 wherein said first conductor of said first and second cables comprises a bundle of wires.

56. The cable assembly of claim 52 wherein the diameters of the wires forming said first conductor of said first and second cables are the same size as the diameters of the wires forming one of said bundles of said second conductor of said first and second cables.

57. The cable assembly of claim 52 wherein said wires of each of said bundles of said second conductor of said first and second cables are twisted.

58. The cable assembly of claim 52 wherein said bundles of said second conductor of said first and second cables are twisted in a direction opposite the direction of twist of their respective wires.

59. The cable assembly of claim 52 wherein the first and second conductors of said first cable are connectable together to together transfer said positive signal portion, and wherein the first and second conductors of said second cable are connectable together to together said negative signal portion.

60. The cable assembly of claim 52 wherein said first cable is adapted to lie flat against a first wall and said second cable is adapted to lie flat against wall perpendicular to said first wall.

61. A conductor assembly for transmitting an electrical signal between a power source and a load, said assembly comprising:

(1) a first cable for carrying the positive portion of said signal, said first cable comprising:
  (a) a first conductor comprising a bundle of wires;
  (b) a second conductor extending to the side of said first conductor in a spaced, parallel relation thereto and comprising a plurality of bundles of wires;
  (c) the diameters of at least one of said wires of said first cable being different from the diameter of at least one other of said wires of said first cable;
  (d) an insualting material extending around said first and second conductors of said first cable;
  (e) said first and second conductors of said first cable being adapted to separately carry different frequency components of said positive signal portion;

(2) a second cable extending to the side of said first cable in a spaced parallel relationship for carrying the negative portion of said signal, said second cable comprising:
  (a) a first conductor comprising a bundle of wires;
  (b) a second conductor extending to the side of said first conductor in a spaced, parallel relation thereto and comprising a plurality of bundles of wires;
  (c) the diameters of at least one of said wires of said second cable being different from the diameter of at least one other of said wires of said second cable;
  (d) an insualating material extending around said first and second conductors of said second cable;
  (e) said first and second conductors of said second cable being adapted to separately carry different frequency components of said negative signal portion; and (3) an insulating material extending between said first and second cables.

62. The cable assembly of claim 61 wherein each of said second conductor of said first and second cables comprises a bundle of relatively large diameter wires, a bundle of relatively small diameter wires, and a bundle of relatively intermediate diameter wires.

63. The cable assembly of claim 61 wherein the diameters of the wires forming said first conductor of said first and second cables are the same size as the diameters of the wires forming one of said bundles of said second conductor of said first and second cables.

64. The cable assembly of claim 61 wherein said wires of each of said bundles of said second conductor of said first and second cables are twisted.

65. The cable assembly of claim 64 wherein said bundles of said second conductor of said first and second cables are twisted in a direction opposite the direction of twist of their respective wires.

66. The cable assembly of claim 61 wherein the first and second conductors of said first cable are connectable together to together transfer said positive signal portion, and wherein the first and second conductors of said second cable are connectable together to together said negative signal portion.

67. The cable assembly of claim 61 wherein said insulating material of said first and second cables is molded into an integral single unit including a plurality of sleeves respectively extending over said first and second conductors of said first and second cables.

68. The cable assembly of claim 61 wherein at least a portion of said insulating material extending between said cables is of a relative small thickness to permit movement of said first cable relative to said second cable.

69. The cable assembly of claim 61 further comprising a ridge formed on said insulating material extending between said cables for receiving a nail to fasten said assembly to a wall.

70. The cable assembly of claim 61 wherein said first cable is adapted to lie flat against a first wall and said second cable is adapted to lie flat against a wall perpendicular to said first wall.

* * * * *